US005577983A

United States Patent [19]

Fraser

[11] Patent Number: 5,577,983

[45] Date of Patent: Nov. 26, 1996

[54] MUSCLE EXERCISER

[76] Inventor: Rosa A. Fraser, 109 Albion Street, Swindon, Wiltshire, SN1 5LP, England

[21] Appl. No.: 307,709

[22] PCT Filed: Apr. 2, 1993

[86] PCT No.: PCT/GB93/00700

§ 371 Date: Oct. 6, 1994

§ 102(e) Date: Oct. 6, 1994

[87] PCT Pub. No.: WO93/20900

PCT Pub. Date: Oct. 28, 1993

[30] Foreign Application Priority Data

Apr. 10, 1992 [GB] United Kingdom ..... 9207912

[51] Int. Cl.[6] ..... A63B 23/00; A61C 5/14

[52] U.S. Cl. ..... 482/11; 601/38; 433/140

[58] Field of Search ..... 482/11, 148; 433/6, 433/73, 140, 229; 601/23, 38

[56] References Cited

U.S. PATENT DOCUMENTS

| | | | |
|---|---|---|---|
| D. 197,889 | 4/1964 | Haas | 482/11 |
| 1,586,499 | 5/1926 | Worth | 601/38 |
| 3,528,655 | 9/1970 | Ruderian | 482/11 |
| 4,515,154 | 5/1985 | Leonard | 433/73 |
| 4,700,695 | 10/1987 | Davis et al. | 482/11 |
| 5,235,991 | 8/1993 | Minneman | 433/140 |

*Primary Examiner*—Stephen R. Crow
*Attorney, Agent, or Firm*—Young & Thompson

[57] ABSTRACT

A muscle exerciser for exercising facial muscles, comprising an elongated handle having a pair of arms diverging from the handle. The handle and arms comprise a rigid assembly that lies in one plane. A body of highly compressible resilient material is mounted one on the end of each arm remote from the handle. There is a pivot on the end of each arm. Each body of highly compressible resilient material is mounted on the pivot for swinging movement on the end of its associated arm relative to the handle about an axis perpendicular to that plane.

1 Claim, 1 Drawing Sheet

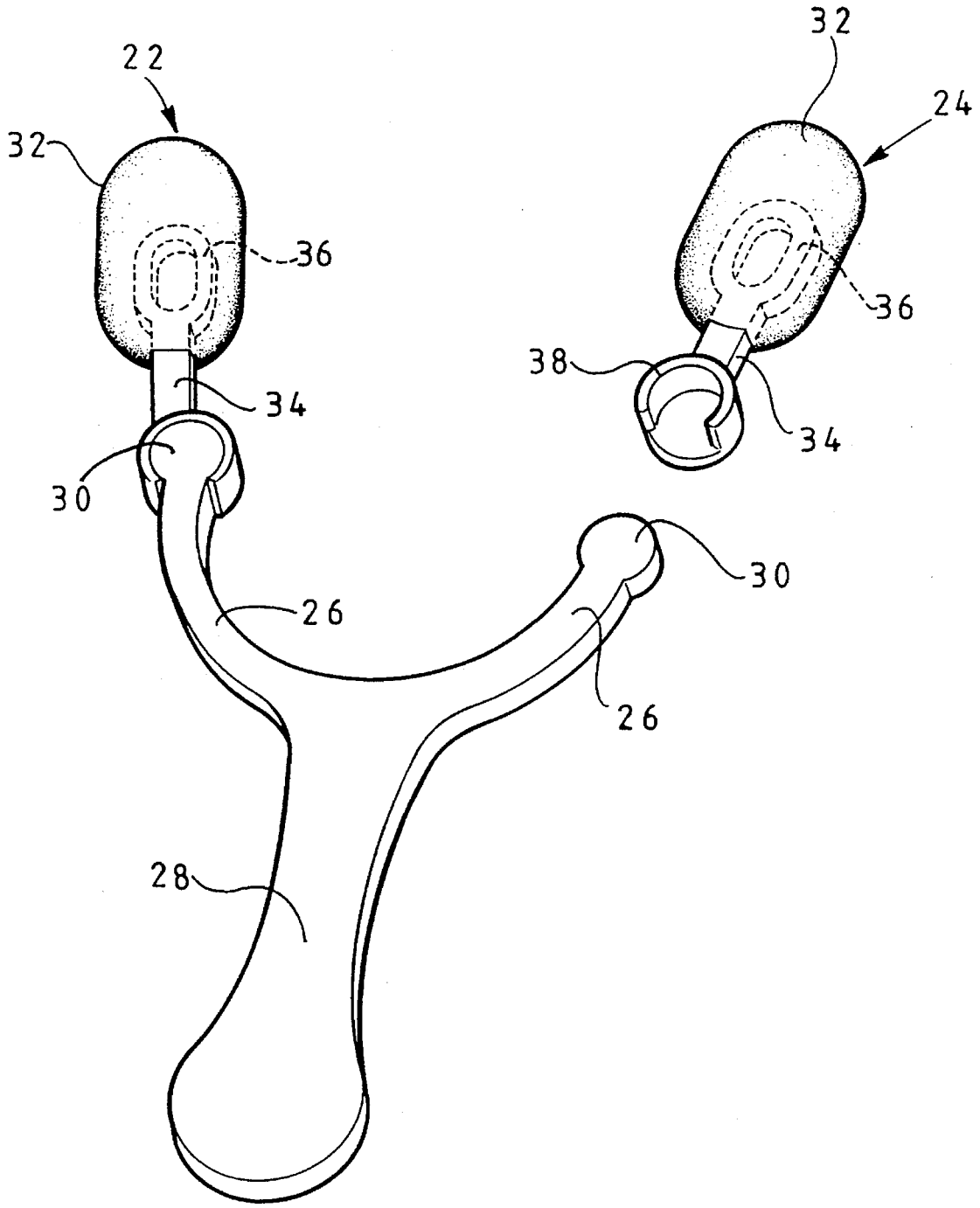
22
32
36
34
30
26
28
32
24
36
38
34
30
26

MUSCLE EXERCISER

The present invention relates to a muscle exerciser.

There are a number of measures which can be employed to prevent the wrinkling of skin which tends to occur with age. One such method is body building, which increases the sizes of body muscles so that the skin covering the muscles is stretched more tightly and consequently gives a less wrinkled appearance. Wrinkles on facial skin are, however, conventionally treated by applying various creams, lotions and electrical impulses to the face, but such treatments are expensive, and electrical impulse treatment should only be performed by qualified therapists.

The present invention has arisen from attempts to overcome some of the above disadvantages.

According to a first aspect of the invention there is provided a muscle exerciser for exercising facial muscles, comprising jaw engaging means movable between a compressed configuration and an expanded configuration, and adapted to be placed between the upper and lower jaws of a user so that closure of the jaws causes movement of the jaw engaging means from its expanded configuration to its compressed configuration, and biasing means for biasing the jaw engaging means towards said expanded configuration, wherein in use the facial muscles are exercised by repeatedly closing the jaws against the action of the biasing means characterised in that the jaw engaging means comprises two separate biting parts adapted to be gripped between the left and right sides of the jaws respectively.

Preferably, each biting part is formed by a piece of resilient material, such as rubber.

The resilient material may be coated with a suitable material, such as a plastics material, to ensure that it does not have an unpleasant taste, and/or to ensure that it can safely and hygienically be placed in the mouth.

Preferably, the muscle exerciser further comprises a handle which is attached to the jaw engaging means so as to allow the user in use to hold the jaw engaging means in position between the upper and lower laws.

Preferably, if the muscle exerciser comprises a handle, the biting parts are removable from the handle so as to allow the biting parts to be replaced when necessary.

According to a second aspect of the invention, there is provided a method of exercising facial muscles using a muscle exerciser according to the first aspect of the invention, the method comprising the steps of placing the jaw engaging means of the muscle exerciser between the upper and lower jaws, and repeatedly closing the jaws against the action of the biasing means.

The invention will now be more particularly described, by way of example only, with reference to the accompanying drawing which shows one embodiment of a muscle exerciser according to the invention.

The muscle exerciser shown in the drawing has two separate biting parts 22 and 24. The biting parts 22 and 24 are designed to be gripped between the rear teeth of the user, one of the biting parts being gripped between the right rear teeth and the other biting part being gripped between the left rear teeth of the user.

The two biting parts 22, 24 are supported at the ends of two arms 26, which are themselves integrally connected to one end of a handle 28. The handle 28 and arms 26 are made of a hard resilient nylon material. A cylindrical head portion 30 is integrally formed at the end of each arm 26 to enable connection to a respective biting part.

Each biting part 22, 24 comprises a chewing member 32 and a connecting member 34 for connecting the chewing member 32 to one of the head portions 30. Each connecting member 34 comprises a generally annular portion 36 which is moulded within one of the chewing members 32, and a recess-defining portion 38 adapted to receive one of the head portions 30. The connecting members 34 are formed from the same resilient nylon material as the handle 28, so as to allow the head portion 30 to be connected to the recess-defining portion 38 by means of a snap fit. This has the advantage of allowing the biting parts 24 to be replaced when they become worn. In the drawing the biting part 24 is shown removed from the handle 28.

Furthermore, once the biting parts 22, 24 are connected to the head portions 30, they are free to pivot within the general plane of the handle 28 and arms 26, so as to accommodate different sized jaws. The chewing members 32 are formed from a highly resilient medical grade PVC material, which allows them to be safely chewed as hard as necessary.

In use, a user bites repeatedly on the biting parts 22, 24 in order to exercise and develop his or her facial muscles.

It has been found that, if this exercise is carried out regularly over a period of time, the facial muscles can develop in a manner which is pleasing to the eye. Not only can the appearance of wrinkles be removed from the skin covering the facial muscles, but the shape of the face and neck can also be recontoured. The muscle exerciser could also be used to build up facial muscles which have suffered as a result of injury or illness, such as a stroke for example.

I claim:

1. A muscle exerciser for exercising facial muscles, comprising an elongated handle having a pair of arms diverging from the handle, said handle and arms comprising a rigid assembly that lies in one plane, and a body of highly compressible resilient material mounted on the end of each arm remote from the handle, pivot means on the end of each arm, each body of highly compressible resilient material being mounted on said pivot means for swinging movement on the end of its associated said arm relative to the handle about an axis perpendicular to said plane.

* * * * *